US011046109B1

(12) United States Patent
Ji

(10) Patent No.: US 11,046,109 B1
(45) Date of Patent: Jun. 29, 2021

(54) ARTWARE WITH PROJECTION FUNCTION

(71) Applicant: SHENZHEN SUNRISE TECHNOLOGY CO., LTD, Shenzhen (CN)

(72) Inventor: Min Ji, Shenzhen (CN)

(73) Assignee: SHENZHEN SUNRISE TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/196,990

(22) Filed: Mar. 9, 2021

(30) Foreign Application Priority Data

Jan. 23, 2021 (CN) ..... 202120202402.5

(51) Int. Cl.

| | |
|---|---|
| ***B44F 1/06*** | (2006.01) |
| ***A63H 23/14*** | (2006.01) |
| ***F21V 5/00*** | (2018.01) |
| ***F21V 14/06*** | (2006.01) |
| ***F21V 5/04*** | (2006.01) |
| ***F21V 9/12*** | (2006.01) |
| ***F21V 31/04*** | (2006.01) |
| ***A63H 19/20*** | (2006.01) |
| ***F21S 10/00*** | (2006.01) |
| ***F21V 3/06*** | (2018.01) |
| ***G09F 19/18*** | (2006.01) |
| ***G09F 19/02*** | (2006.01) |

(52) U.S. Cl.
CPC ..... *B44F 1/066* (2013.01); *A63H 23/14* (2013.01); *F21V 5/006* (2013.01); *F21V 5/043* (2013.01); *F21V 14/065* (2013.01); *A63H 19/20* (2013.01); *F21S 10/002* (2013.01); *F21V 3/063* (2018.02); *F21V 9/12* (2013.01); *F21V 31/04* (2013.01); *G09F 19/02* (2013.01); *G09F 19/18* (2013.01)

(58) Field of Classification Search
CPC ..... F21S 10/002; A63H 19/20; A63H 23/14; F21V 9/12; F21V 3/063; F21V 31/04; G09F 19/02; G09F 19/18
See application file for complete search history.

(56) References Cited

U.S. PATENT DOCUMENTS

| | | | | |
|---|---|---|---|---|
| 1,994,064 A * | 3/1935 | Caruso | A63H 19/20 | 446/438 |
| 2,589,530 A * | 3/1952 | Brightwell | G03B 21/00 | 353/4 |
| 5,105,343 A * | 4/1992 | Wakimoto | F21L 4/00 | 362/101 |
| 7,905,728 B2 * | 3/2011 | Piontek | G09B 23/12 | 434/276 |
| 8,695,247 B1 * | 4/2014 | Yang | G09F 13/32 | 40/442 |
| 9,052,077 B2 * | 6/2015 | Chien | F21S 10/002 | |

(Continued)

FOREIGN PATENT DOCUMENTS

DE 29605050 U1 * 6/1996 ..... F21V 33/0028

*Primary Examiner* — Alexander K Garlen
*Assistant Examiner* — Colin J Cattanach

(57) ABSTRACT

The present disclosure provides an artware with a water stirring function and a projection function. The artware includes a housing structure, a control circuit board including a switch, a magnetic rotating unit controlled by the control circuit board, and a projection unit controlled by the control circuit board. The control circuit board, the magnetic rotating unit, and the projection unit are arranged in the hosing structure.

7 Claims, 4 Drawing Sheets

(56) References Cited

U.S. PATENT DOCUMENTS

| | | | | |
|---|---|---|---|---|
| 2003/0067764 | A1* | 4/2003 | Lau Ting Yup | G09F 13/24 362/84 |
| 2006/0002670 | A1* | 1/2006 | Lin | G02B 6/0006 385/115 |
| 2014/0268663 | A1* | 9/2014 | Yang | F21V 31/04 362/101 |
| 2014/0268672 | A1* | 9/2014 | Yang | F21S 10/002 362/101 |
| 2015/0070876 | A1* | 3/2015 | Chien | F21S 10/002 362/101 |
| 2018/0231199 | A1* | 8/2018 | Chien | F21V 23/04 |
| 2019/0120450 | A1* | 4/2019 | Chien | F21V 14/003 |
| 2019/0230324 | A1* | 7/2019 | Chien | F21V 14/02 |

* cited by examiner

ARTWARE WITH PROJECTION FUNCTION

TECHNICAL FIELD

The present disclosure relates to a field of artware technology, and in particular to an artware with a projection function.

BACKGROUND

In the prior art, artwares with magnetic water stirring device are able to stir water through magnetic force to form a dynamic visual effect. For example, the Chinese application 201922317540.3 with a patented date of Aug. 28, 2020, discloses an artware with a magnetic water stirring device. The disclosed artware includes a shell, a transparent water container arranged in the shell and a magnetic-drive rotation module. The magnetic-drive rotation module includes a silicone rotor, a plastic main rotor, and a motor. The main rotor is fixed on an output shaft of the motor. The water container is arranged above the main rotor. The silicone rotor is freely arranged in the water container. The main rotor and the silicone rotor are respectively comprises strong magnetic pieces, and the silicone rotor is abstracted to an inner bottom surface of the water container by the strong magnetic piece in the main rotor.

The artware with the magnetic water stirring device encloses two mutually attracted strong magnetic piece in the corresponding rotors, so that a structure of the artware is simple, assembly process is simple, assembly difficulty is reduced, and a production cost is greatly reduced. Further, the silicone rotor including the strong magnetic piece is freely arranged on a bottom portion of the water container filled with water, which is convenient for cleaning an inside of the water container.

However, the artware with the magnetic water stirring device only present a dynamic water stirring effect and does not have a projection function.

Therefore, it is necessary to provide an artware with magnetic water stirring and projection functions to solve the above technical problems.

SUMMARY

A main technical problem solved by the present disclosure is to provide an artware with a magnetic water stirring function and a projection function, which solves a problem that the conventional magnetic water stirring artware can only meet the water stirring effect and only has a single function. By setting an integrated projection unit, functions of the artware are increased. When working, dynamic effects of water stirring and lighting effects appear at the same time, which improves user experience.

To solve above technical problems, the present disclosure provides an artware with a water stirring function and a projection function. The artware comprises a housing structure, a control circuit board including a switch, a magnetic rotating unit controlled by the control circuit board, and a projection unit controlled by the control circuit board. The control circuit board, the magnetic rotating unit, and the projection unit are arranged in the hosing structure.

In one embodiment, the projection unit comprises an aluminum substrate electrically connected to the control circuit board and a laser tube arranged on the aluminum substrate.

In one embodiment, the projection unit comprises a film, a light source assembly configured to illuminate the film and a lens assembly configured to project patterns on the film to an outside.

In one embodiment, the light source assembly comprises an aluminum substrate electrically connected to the control circuit board and LED lamp beads arranged on the aluminum substrate.

In one embodiment, the lens assembly comprises a first lens, a second lens, and a third lens. The first lens, the second lens, and the third lens are arranged in sequence along a direction of emitted light from the light source assembly. The first lens and the second lens are arranged on an inner side of the film. The third lens is arranged on an outer side of the film.

In one embodiment, the magnetic rotating unit comprises a transparent shell configured to hold water, a driven rotor freely arranged in the transparent shell, a motor seat plate arranged on a lower portion of the transparent shell, a motor fixed on the motor seat plate, and a driving rotor fixedly connected to a shaft of the motor. Each of the driving rotor and the driven rotor comprise a built-in magnet;

In one embodiment, the magnetic rotating unit further comprises a bracket arranged in the transparent shell and connected with the transparent shell. The driven rotor is arranged under the bracket.

In one embodiment, ornaments are arranged on a top surface of the bracket.

In one embodiment, the housing structure includes a train box shell, a locomotive shell, a lamp shell connected to the locomotive shell, and a train bottom plate connected to a bottom portion of the train box shell. The control circuit board is connected to the train bottom plate. A battery and a battery cover are arranged on the train bottom plate. The magnetic rotating unit is arranged in the train box shell. The projection unit is arranged in the lamp shell.

In one embodiment, an upper cover is connected to a top portion of the train box shell. The upper cover comprises a skylight.

In the present disclosure, the magnetic rotating unit presents a dynamic water stirring effect, and meets meet user's entertainment experience needs.

The integrated projection unit has a projection function, which enriches the functions of the artware of the present disclosure.

Figure 1:
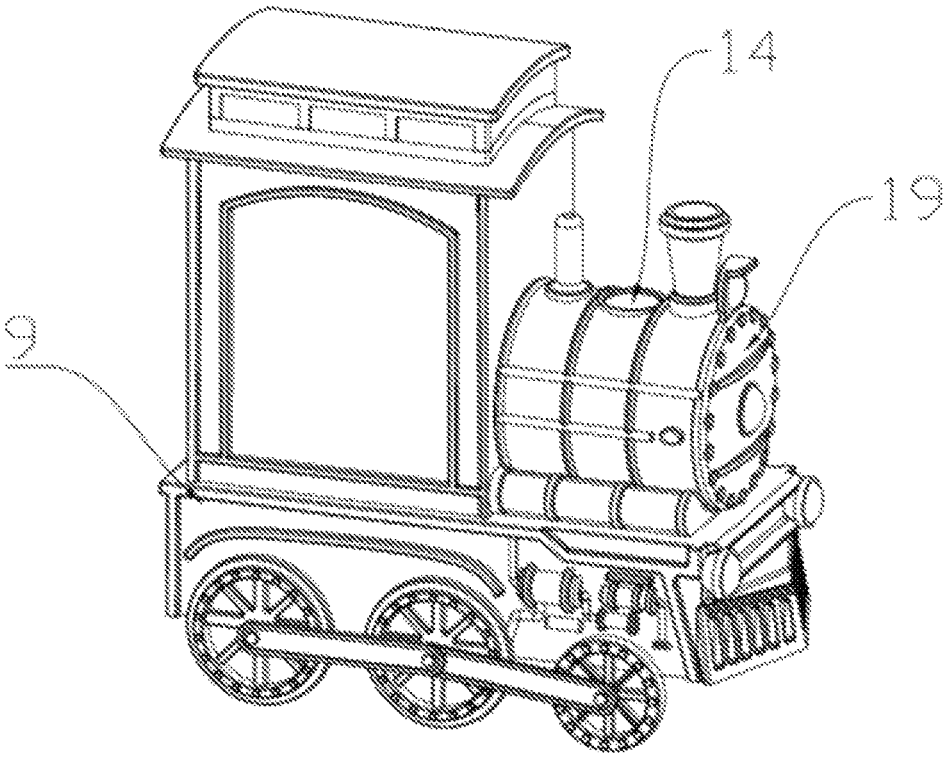
FIG. 1 is a perspective schematic diagram showing a structure of an artware with a projection function of the present disclosure.

Components corresponding to the labels in the drawings are as follows: 1—skylight; 2—upper cover; 3—transparent shell; 4—bracket; 5—driven rotor; 6—motor seat plate; 7—driving rotor; 8—motor; 9—train box shell; 10—control circuit board; 11—train bottom plate; 12—battery cover; 13—third lens; 14—lamp shell; 15—film; 16—second lens; 17—first lens; 18—aluminum substrate; 19—locomotive shell.

DETAILED DESCRIPTION

Technical schemes of the present disclosure will be described in detail below in conjunction with the drawings.

Figure 4:
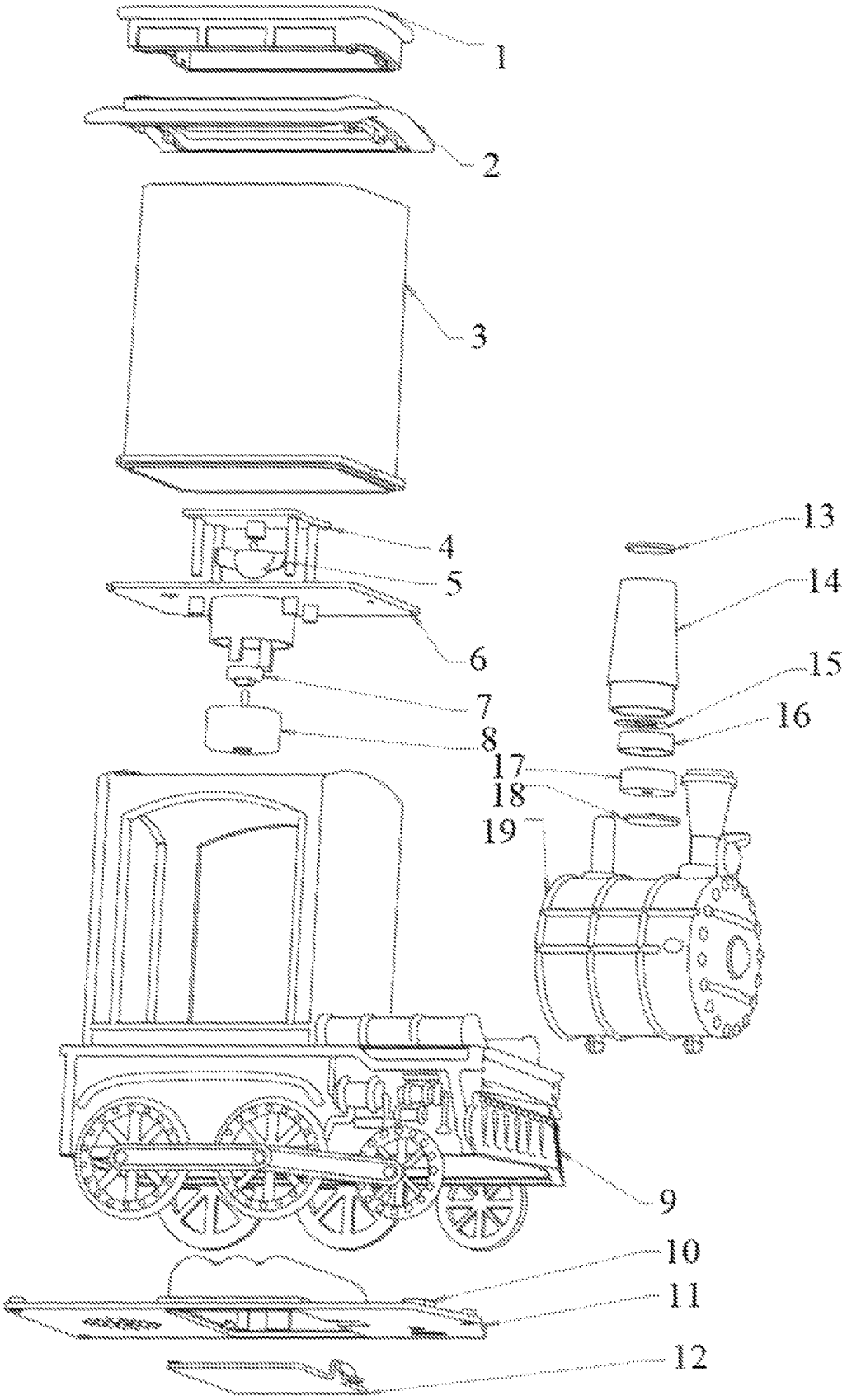
FIG. 4 is an exploded perspective schematic diagram of the artware with the projection function of FIG. 1.

As shown in FIGS. 1 and 4, the present disclosure provides an artware with a water stirring function and a projection function. The artware comprises a housing structure, a control circuit board 10 including a switch, a magnetic rotating unit controlled by the control circuit board, a projection unit controlled by the control circuit board 10. The magnetic rotating unit realizes a dynamic water stirring effect and the projection unit projects colored light or patterns. The control circuit board 10, the magnetic rotating unit, and the projection unit are arranged in the hosing structure.

In the embodiment, the artware with magnetic water and projection function comprises integrated magnetic rotation unit and projection unit, which has fully functions and improves a user's experience.

In one embodiment, as shown in FIG. 4, the projection unit comprises an aluminum substrate 18 electrically connected to the control circuit board 10 and a laser tube arranged on the aluminum substrate. The projection unit projects laser light. As for the color of the laser light, it may be red, green, or other colors, which is set according to specific design requirements and is not limited thereto.

In one embodiment, as shown in FIG. 4, the projection unit comprises a film 15, a light source assembly configured to illuminate the film 15, and a lens assembly configured to project patterns on the film to an outside. The artware with magnetic water stirring function and the projection function of the embodiment is able to project the pattern effect through the lens assembly while stirring water. Furthermore, the light source assembly comprises the aluminum substrate 18 electrically connected to the control circuit board 10 and LED lamp beads arranged on the aluminum substrate.

Furthermore, as shown in FIG. 4, the lens assembly comprises a first lens 17, a second lens 16, and a third lens 13. The first lens 17, the second lens 16, and the third lens 13 are arranged in sequence along a direction of emitted light from the light source assembly. The first lens 17 and the second lens 16 are arranged on an inner side of the film 15. The third lens 13 is arranged on an outer side of the film 15.

Specifically, the first lens 17 is sleeved on the LED lamp beads to realize convergent output of the light, and the second lens 16 adjusts a direction of the light irradiated thereon, so that the second lens 16 projects parallel light to the film 15 to project the pattern, and the third lens 13 projects the pattern onto a ceiling of a room.

In one embodiment, FIG. 4 shows a specific structure of the magnetic rotating unit. The magnetic rotating unit comprises a transparent shell 3 configured to hold water, a driven rotor 5 freely arranged in the transparent shell 3, a motor seat plate 6 arranged on a lower portion of the transparent shell 3, a motor 8 fixed on the motor seat plate 6, and a driving rotor 7 fixedly connected to a shaft of the motor 8. Each of the driving rotor 7 and the driven rotor 5 comprise a built-in magnet.

Furthermore, as shown in FIG. 4, the magnetic rotating unit further comprises a bracket 4 arranged in the transparent shell 3 and connected with the transparent shell 3. The driven rotor 5 is arranged under the bracket 4. Ornaments are arranged on a top surface of the bracket 4, which is based on requirements of actual needs. If ornaments are not required, they may not be provided, which is not limited thereto.

Figure 2:
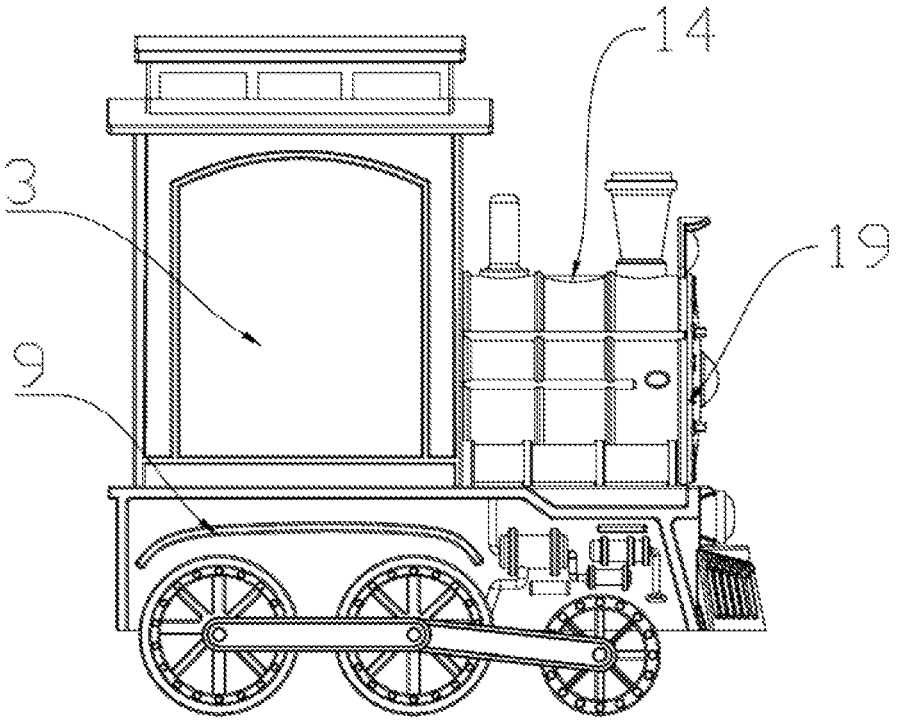
FIG. 2 is a front schematic diagram of the artware with the projection function of FIG. 1.
Figure 3:
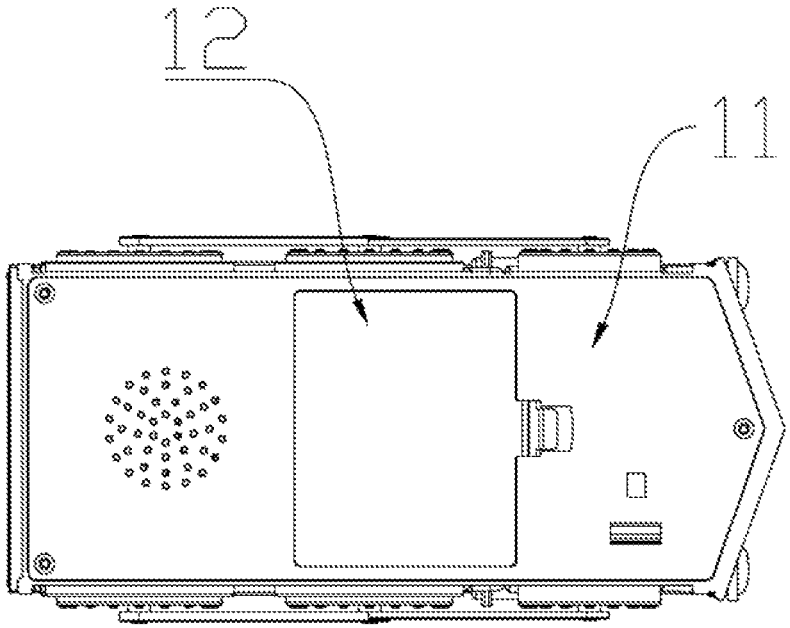
FIG. 3 is a bottom schematic diagram of the artware with the projection function of FIG. 1.

In one embodiment, as shown in FIGS. 1-4, the housing structure includes a train box shell 9, a locomotive shell 19, a lamp shell 14 connected to the locomotive shell 19, and a train bottom plate 11 connected to a bottom portion of the train box shell 9. The control circuit board 10 is connected to the train bottom plate 11. A battery and a battery cover 12 are arranged on the train bottom plate 11. The magnetic rotating unit is arranged in the train box shell 9. The projection unit is arranged in the lamp shell 14. The battery provides power to the control circuit board 10. The specific switch of the control circuit board 10 is arranged on the train bottom plate 11. Of course, the lamp shell 14 is able to be embedded in the locomotive shell 19. As shown in FIGS. 1-3, the second lens 16 is able to be arranged on the top portion of the locomotive shell 19, as long as a light outlet of the lamp shell 14 is exposed outside the locomotive shell 19, which are all within the protection scope of the present disclosure.

In one embodiment, an upper cover 2 is connected to a top portion of the train box shell 9. The upper cover 2 comprises a skylight 1. Through the skylight 1, the user is able to see the dynamic effect of the water in the transparent shell 3.

In the embodiment of the present disclosure, the control circuit board 10 is electrically connected to the projection unit and the magnetic rotating unit through wires (not shown in the drawings). The specific projection unit and the magnetic rotating unit are electrically connected to the control circuit board 10 by respective two wires.

The above are only the embodiments of the present disclosure, and do not limit the patent scope of the present disclosure. Any equivalent structure made by using the specification and drawings of the present disclosure, or any equivalent structure directly or indirectly applied to other related technical fields, should be included in the protection scope of the present disclosure.

What is claimed is:

1. An artware with a projection function, comprising a housing structure;

a control circuit board comprising a switch arranged in the housing structure;

a magnetic rotating unit arranged in the housing structure and controlled by the control circuit board;

a projection unit arranged in the housing structure and controlled by the control circuit board;

wherein the magnetic rotating unit comprises a transparent shell configured to hold water, a driven rotor freely arranged in the transparent shell, a motor seat plate arranged on a lower portion of the transparent shell, a motor fixed on the motor seat plate, and a driving rotor fixedly connected to a shaft of the motor; each of the driving rotor and the driven rotor comprise a built-in magnet;

wherein the projection unit comprises a film, a light source assembly configured to illuminate the film, and a lens assembly configured to project patterns on the film to an outside.

2. The artware with the projection function according to claim 1, wherein the light source assembly comprises an aluminum substrate electrically connected to the control circuit board and LED lamp beads arranged on the aluminum substrate.

3. The artware with the projection function according to claim 1, wherein the lens assembly comprises a first lens, a second lens, and a third lens; the first lens, the second lens, and the third lens are arranged in sequence along a direction of emitted light from the light source assembly; the first lens and the second lens are arranged on an inner side of the film; the third lens is arranged on an outer side of the film.

4. The artware with the projection function according to claim 1, wherein the magnetic rotating unit further comprises a bracket arranged in the transparent shell and connected with the transparent shell; the driven rotor is arranged under the bracket.

5. The artware with the projection function according to claim 4, wherein ornaments are arranged on a top surface of the bracket.

6. The artware with the projection function according to claim 1, wherein the housing structure includes a train box shell, a locomotive shell, a lamp shell connected to the locomotive shell, and a train bottom plate connected to a bottom portion of the train box shell; the control circuit board is connected to the train bottom plate; a battery and a battery cover are arranged on the train bottom plate; the magnetic rotating unit is arranged in the train box shell; the projection unit is arranged in the lamp shell.

7. The artware with the projection function according to claim 6, wherein an upper cover is connected to a top portion of the train box shell; the upper cover comprises a skylight.

* * * * *